US007559627B2

(12) United States Patent
Bradley

(10) Patent No.: US 7,559,627 B2
(45) Date of Patent: Jul. 14, 2009

(54) APPARATUS, SYSTEM, AND METHOD FOR ELECTRORHEOLOGICAL PRINTING

(75) Inventor: Timothy Graham Bradley, Longmont, CO (US)

(73) Assignee: InfoPrint Solutions Company, LLC, Boulder, CO (US)

( * ) Notice: Subject to any disclaimer, the term of this patent is extended or adjusted under 35 U.S.C. 154(b) by 157 days.

(21) Appl. No.: 10/799,486

(22) Filed: Mar. 12, 2004

(65) Prior Publication Data

US 2005/0200644 A1 Sep. 15, 2005

(51) Int. Cl.
*B41J 2/06* (2006.01)

(52) U.S. Cl. ..... 347/55

(58) Field of Classification Search ..... 347/55, 347/6, 46

See application file for complete search history.

(56) References Cited

U.S. PATENT DOCUMENTS

| | | | | | |
|---|---|---|---|---|---|
| 2,417,850 | A | | 3/1947 | Winslow | 175/320 |
| 3,047,507 | A | | 7/1962 | Winslow | 252/75 |
| 4,364,054 | A | * | 12/1982 | Kelly | 347/55 |
| 4,812,251 | A | | 3/1989 | Stangroom | 252/75 |
| 5,227,814 | A | * | 7/1993 | Mutou | 347/55 |
| 5,362,427 | A | * | 11/1994 | Mitchell, Jr. | 264/497 |
| 5,481,280 | A | | 1/1996 | Lam et al. | 346/140.1 |
| 5,510,817 | A | | 4/1996 | Sohn | 347/21 |
| 5,576,747 | A | | 11/1996 | Sohn | 347/48 |
| 5,745,128 | A | | 4/1998 | Lam et al. | 346/140.1 |
| 5,777,644 | A | * | 7/1998 | Yamaguchi et al. | 347/68 |
| 5,801,730 | A | * | 9/1998 | Shima et al. | 347/55 |
| 5,903,291 | A | * | 5/1999 | Yoshimura et al. | 347/48 |
| 6,048,050 | A | * | 4/2000 | Gundlach et al. | 347/46 |
| 6,158,844 | A | * | 12/2000 | Murakami et al. | 347/55 |
| 6,224,193 | B1 | * | 5/2001 | Minemoto et al. | 347/55 |
| 6,296,347 | B1 | * | 10/2001 | Shibata | 347/55 |
| 6,312,110 | B1 | * | 11/2001 | Darty | 347/55 |
| 6,382,771 | B1 | * | 5/2002 | Ikeda et al. | 347/55 |
| 6,406,133 | B1 | * | 6/2002 | Abe | 347/55 |
| 6,695,439 | B2 | * | 2/2004 | Takahashi | 347/72 |
| 6,932,458 | B2 | * | 8/2005 | Howkins et al. | 347/47 |
| 7,042,476 | B2 | * | 5/2006 | Wiedemer | 347/141 |
| 2002/0126167 | A1 | * | 9/2002 | Kimura | 347/11 |

FOREIGN PATENT DOCUMENTS

EP 0911164 A2 4/1999

* cited by examiner

*Primary Examiner*—Julian D Huffman
*Assistant Examiner*—Jason S Uhlenhake
(74) *Attorney, Agent, or Firm*—Duft Bornsen & Fishman LLP

(57) ABSTRACT

An apparatus, system, and method are disclosed for electrorheological printing. The apparatus includes a pressurized ink chamber, a stimulator, and an electrode arrangement. The pressurized ink chamber is configured to retain an electrorheological ink and, under certain circumstances, discharge the electrorheological ink through one or more nozzles in a nozzle array. The stimulator is configured to generate a synchronization signal to increase the pressure of the electrorheological ink in the pressurized ink chamber. The electrode assembly is configured to create an electric field at each of the nozzles in the nozzle array. The electric field within the volume of a single nozzle acts as an electrorheological valve to change the viscosity and control the flow of the electrorheological ink within the nozzle. The absence of an electric field allows the electrorheological ink to fully discharge. A strong electric field stops the flow of the electrorheological ink. An intermediate electric field slows the flow of the electrorheological ink.

20 Claims, 6 Drawing Sheets

APPARATUS, SYSTEM, AND METHOD FOR ELECTRORHEOLOGICAL PRINTING

BACKGROUND OF THE INVENTION

1. Field of the Invention

This invention relates to ink jet printing and more particularly relates to using electrorheological ink and an electrorheological (ER) valve in a printing environment.

2. Description of the Related Art

Ink jet printing is a major market within the computer industry. It reaches everything from personal computing to high-end, volume printing. Presently, two main types of ink jet printers are in use. These are 1) continuous ink jet (CIJ) printers, and 2) drop on demand (DOD) ink jet printers. While each of these printing technologies has certain advantages over the other, they also each suffer from particular disadvantages. In particular, these printing technologies as currently known suffer in the area of drop creation. In other words, these printing technologies are in certain ways inadequate in terms of creating ink drops and discharging the ink drops from a nozzle to a print surface.

The CIJ print technology generally includes a drop generator and a drop steering means. The drop generator discharges ink drops toward the print surface while the steering means steers the drops either onto the print surface or into a gutter. For example, the steering means may include two electrically charged conductive plates aligned in parallel with the path of the ink drop. In this way, the CIJ print technology maintains a continuous stream of ink from the drop generator, steering the ink drops into the gutter when not printing on the print surface. The ink in the gutter may be recycled within the printing system.

This continuous flow of ink through the nozzles of the drop generator poses several disadvantages. For example, steering the unused ink into the gutter for recycling may create a significant need for filtering the recycled ink prior to using the ink again at the drop generator. Additionally, the continuous flow of ink can have harmful effects on the nozzles, as well as the electrodes. The nozzles and electrodes may be subject to extensive contamination due to, among other things, the continuous flow of ink and the use of a significant amount of recycled ink, where the recycled ink may be less pure with each gutter and reuse cycle.

The DOD print technology has certain advantages over the CIJ print technology in that the DOD print technology does not maintain a continuous flow of ink from the drop generator. However, the DOD print technology requires a complicated drop creation system that adds cost and complexity to the DOD printers.

Other printing systems incorporate certain other technologies in an attempt to overcome some of these disadvantages of the CIJ and DOD print technologies. One technology that has been combined with certain other printing technologies was first reported in the 1940's and is referred to as electrorheology. Electrorheology is the study of fluid viscosity in the presence of an electric charge or field. Electrorheology is described in further detail in U.S. Pat. No. 3,047,507, issued to Willis M. Winslow on Jul. 31, 1962, entitled "Field Responsive Force Transmitting Compositions."

An electrorheological fluid that changes viscosity in response to an electric field may include suspended particles within the fluid. In the presence of an electric field, these suspended particles may align themselves in a manner that increases the viscosity of the fluid. This property has also been referred to as "electro-viscosity."

Combining electrorheology with printing technologies has presented certain problems. For example, some inventors have found it difficult to supply a sufficient voltage to an electrode in order to fully stop the flow of an electrorheological ink. The voltage necessary to slow or stop the flow of an electrorheological fluid may depend on numerous factors, including the original viscosity of the fluid, the volume of the fluid, the pressure of the fluid within a chamber, the area of the discharge aperture, the permeation of the suspended particles within the fluid, the type of electrode creating the electric field, the number of electrodes, the power supplied to the electrode(s), and so forth.

From the foregoing discussion it should be apparent that a need exists for an apparatus, system, and method that overcome the disadvantages of currently known CIJ and DOD printing techniques, as well as the previous failures to efficiently integrate electrorheological technologies into a printing system. Beneficially, such an apparatus, system, and method would avoid the complicated drop creation systems of DOD printing, overcome continuous ink streaming and the need for substantial gutter recycling, and incorporate electrorheoligical technology in a cost-effective and energy-efficient manner.

SUMMARY OF THE INVENTION

The present invention has been developed in response to the present state of the art, and in particular, in response to the problems and needs in the art that have not yet been fully solved by currently available printing systems. Accordingly, the present invention has been developed to provide an apparatus, system, and method for electrorheological printing that overcome many or all of the above-discussed shortcomings in the art.

In certain embodiments, the apparatus for electrorheological printing includes a pressurized ink chamber, a stimulator, and an electrode arrangement. The apparatus further may include an electrorheological ink. The pressurized ink chamber may be configured to retain the electrorheological ink within a defined volume cavity and maintain a specific pressure within the volume cavity. The pressurized ink chamber, in one embodiment, is in fluid communication with one or more nozzles that together may form a nozzle array. The phrase "fluid communication" refers to the ability of the electrorheological ink, for example, to flow from the pressurized ink chamber directly or indirectly to the nozzle array. Within this description, reference using the terms "nozzle" and "nozzles" are understood to be interchangeable unless noted otherwise.

The stimulator is configured, in one embodiment, to generate a synchronization signal that physically increases the pressure within the pressurized ink chamber for a particular duration of time. More specifically, the stimulator may generate a synchronization signal that increases the pressure from below a threshold to above a threshold, where the threshold corresponds to a pressure at which the ink may be discharged from the pressurized ink chamber through one or more nozzles.

The electrode arrangement may include one or more electrodes that are located near a nozzle and oriented so that the electrode arrangement may effectuate an electric field within the volume cavity of the nozzle. In a further embodiment, every nozzle within a nozzle array may have an associated, independently controllable electrode arrangement. In certain embodiments, the electrode arrangement comprises a pair of ring electrodes that circumscribe the cylindrical wall of a nozzle. However, the electrode arrangement is not limited to exactly two electrodes or specifically to ring electrodes.

The electrode assembly, when creating an electric field at a nozzle containing an electrorheological fluid, defines an electrorheological (ER) valve in that the electric field can influence the flow of the electrorheological fluid through the nozzle. In one embodiment, the ER valve can slow the electrorheological ink by effectively increasing the viscosity of the electrorheological ink in response to the presence of the electric field. In a further embodiment, the ER valve may completely stop the flow of the electrorheological ink when the electric field is at a sufficient intensity.

In a further embodiment of the present invention, the apparatus for electrorheological printing is provided with a logic unit containing a plurality of modules configured to control the steps of electrorheological printing. These modules in the described embodiments include a print control module, a pump control module, a synchronization signal module, a print signal module, an electrode control module, a viscosity control module, and a media compensation module.

In one embodiment, the print control module is configured to receive a print signal. The print control module also may be configured to generate a synchronized print signal that corresponds to the synchronization signal generated by the stimulator. The synchronization control module is configured, in one embodiment, to control the stimulator and thereby determine the characteristics of the generated synchronization signal.

The electrode control module may be configured to control the voltage applied to one or more of the electrodes in an electrode arrangement, in one embodiment, and to each of the electrodes at each of the nozzles in a nozzle array, in a further embodiment. The electrode control module also may be configured to synchronize the voltage applied to an electrode with the synchronization signal and the print signal.

In a further embodiment, the pump control module is configured to control a pump that supplies ink to the pressurized ink chamber. Additionally, the viscosity control module may be configured to control the intensity of the electric field at a nozzle in order to control the viscosity of the electrorheological ink as the electrorheological ink discharges from the nozzle. Furthermore, the media compensation module may be configured to modify the voltage control of the electrode arrangement to compensate for a variation in a speed, or feed rate, of a print media on which the electrorheological ink is being printed. Other features of additional embodiments of the apparatus are also presented.

A method of the present invention is also presented for electrorheological printing. The method in the disclosed embodiments substantially includes the steps necessary to carry out the functions presented above with respect to the operation of the described apparatus and system. In one embodiment, the method includes pressurizing the electrorheological ink in the ink chamber, generating a synchronization signal, and creating an electric field to control the flow of the electrorheological ink at the nozzle.

In further embodiments of the method for electrorheological printing, the method includes receiving a print signal, controlling a pump, discharging an ink drop from the nozzle, controlling the viscosity of the electrorheological ink at the nozzle, and altering one or more steps of the electrorheological printing in order to compensate for a variation in the feed rate of the print media.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
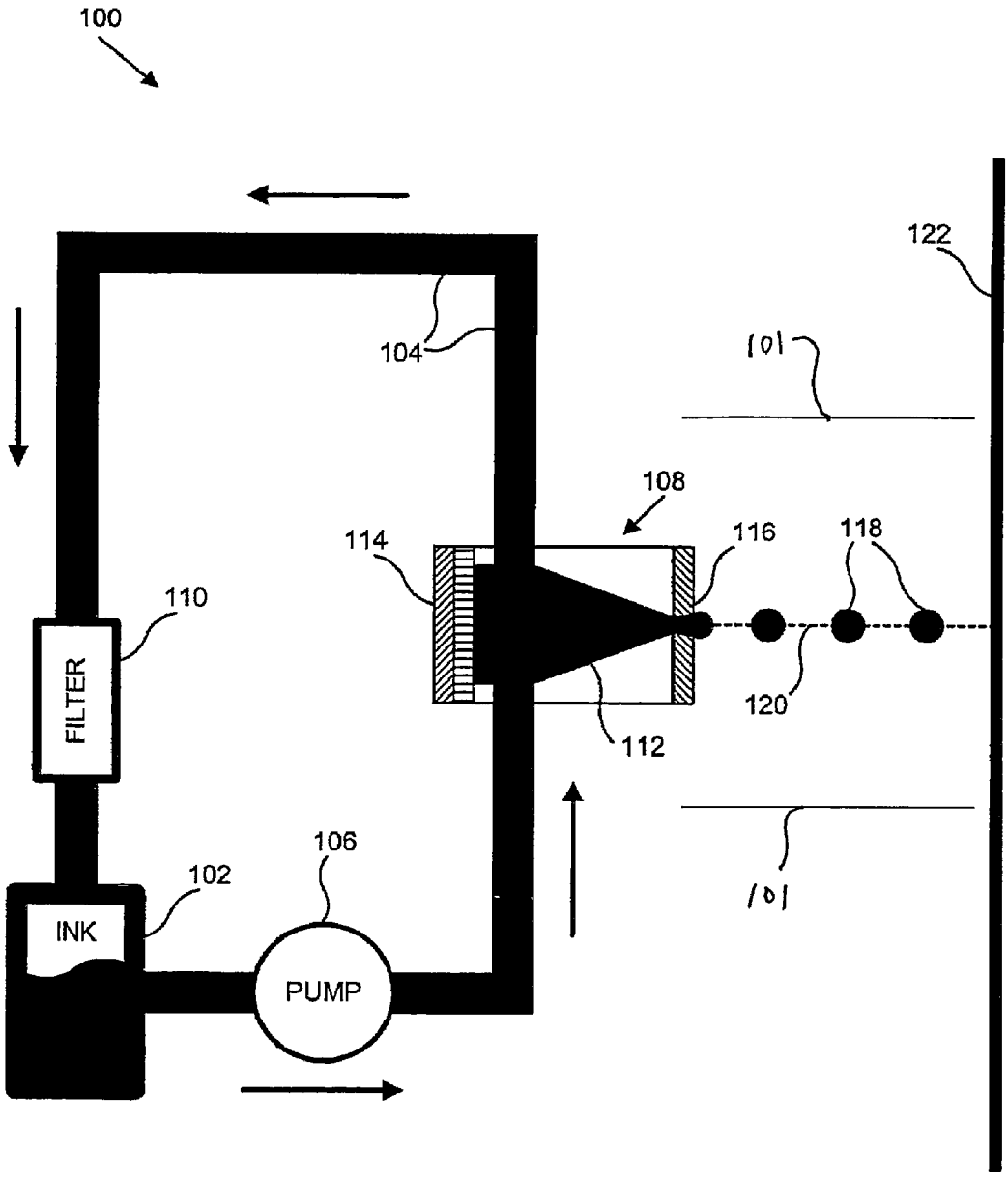
FIG. 1 is a schematic block diagram illustrating one embodiment of a printing system in accordance with the present invention.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code could be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

FIG. 1 depicts one embodiment of a printing system 100 that may incorporate the present invention. The illustrated printing system 100 includes an ink reservoir 102 that is connected via an ink channel 104 to a pump 106. The pump 106 draws ink from the ink reservoir 102 through the ink channel 104. The pump 106 advances the ink through the ink channel 104 to a drop generator 108. The drop generator 108 is configured to discharge ink, which subsequently may be deposited on a print surface. The drop generator 108 will be described in more detail below.

Ink that is not used at the drop generator 108 for printing may continue through one or more ink channels 104 back to the ink reservoir 102. In one embodiment, the ink may pass through a filter 110 in order to remove undesirable particles that may have entered the ink during circulation of the ink within the printing system 100.

The ink reservoir 102, ink channels 104, pump 106, and filter 110 may be similar, in certain embodiments, to components that may be used in, for example, a continuous ink jet printer (not shown). However, in alternate embodiments, the ink reservoir 102, ink channels 104, pump 106, and filter 110 may be substantially different from components typically used in CIJ printers. For example, the pump 106, in one embodiment, may be controlled differently in order to regulate the pressure of the ink at the drop generator 108. In a further embodiment, the printing system 100 may included fewer or more components that are shown in FIG. 1.

The illustrated drop generator 108 includes a pressurized ink chamber 112, a stimulator 114, and a nozzle array 116. The nozzle array 116 will be discussed in more detail with reference to FIG. 2. The pressurized ink chamber 112 is configured to retain a volume of ink and maintain the ink at a certain pressure. The normal pressure inside the pressurized ink cavity 112 is less than the pressure required to discharge the ink through the nozzle array 116.

The stimulator 114, in one embodiment, is configured to increase the pressure within the pressurized ink chamber 112 so that ink may discharge through the nozzle array 116. However, in certain embodiments described below, the ink may be retained within the pressurized ink chamber 116 during the period of increased pressure caused by the stimulator 114. In one embodiment, the stimulator 114 may be an acoustic stimulator. Alternately, the stimulator 114 may be a piezoelectric stimulator. In further embodiments, the stimulator 114 may increase the pressure on a periodic basis or, in some implementations, on an aperiodic or asynchronous basis.

When the pressure in the pressurized ink chamber 112 is increased beyond a threshold, such as when the stimulator 114 causes the pressure to temporarily increase above the normal pressurized state, ink may be discharged through the nozzle array 116 in the form of drops 118, for example. The ink drops 118 may be of varying sizes and configurations depending on the pressure of the pressurized ink chamber 112, the control of the nozzle array, and so forth. In certain embodiments, the ink may be discharged in other similar forms, included a stream, a spray, a particle, and so forth.

In one embodiment, the ink drops 118 travel along a path 120 and are deposited on a print surface 122. The type of print surface 122 on which the ink drops 118 are deposited may be of little relevance to certain embodiments of the present invention. In a further embodiment, the path 120 of the ink drops 118 may be influenced or modified by deflection plates 101 (see FIG. 1), for example, or another type of path modifier. One embodiment of deflection plates 101 may include a pair of electrically conductive plates approximately aligned in parallel with the ink path 120. The conductive plates, when energized, may direct the ink drops 118 in certain directions, such as toward or away from one plate or the other.

Figure 2:
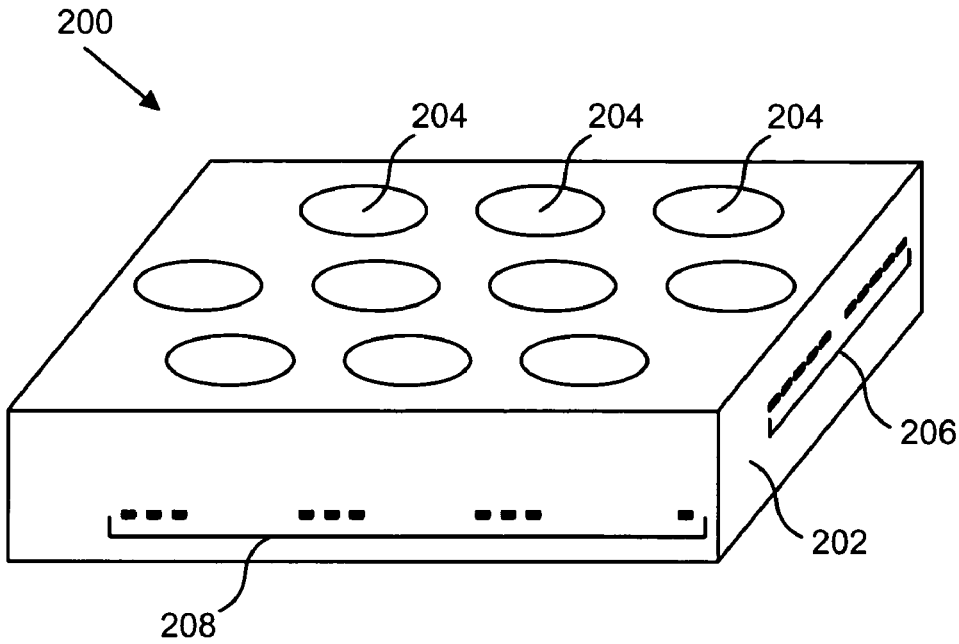
FIG. 2 is a schematic block diagram illustrating one embodiment of a nozzle array in accordance with the present invention.

FIG. 2 depicts one embodiment of a nozzle array 200 that is substantially similar to the nozzle array 116 of the drop generator 108 shown in FIG. 1. The illustrated nozzle array 200 includes a nozzle substrate 202 having a plurality of individual nozzles 204. In one embodiment, each nozzle 204 may be a substantially cylindrical cavity (or via) through the nozzle substrate 204. Other implementations of the nozzles 204 are also possible within the scope of certain embodiments of the present invention. One embodiment of a nozzle 204 is described in more detail with reference to FIG. 3.

The illustrated nozzle array 200 also includes a first set of electrical leads 204 206 and a second set of electrical leads 208. In one embodiment, each electrical lead 206, 208 is connected to a distinct electrode (not shown). Each electrode is associated with and oriented in relation to a nozzle 204. More than one electrode may be associated with and oriented in relation to a single nozzle 204. In another embodiment, the first set of electrical leads 206 and/or the second set of electrical leads 208 may be applied to a surface of the nozzle substrate 202 rather than embedded within the nozzle substrate 202. Applying the electrical leads 206, 208 to the surface of the nozzle substrate 202 may be advantageous, in certain embodiments, for purposes of manufacturing the nozzle array 200.

Figure 3:
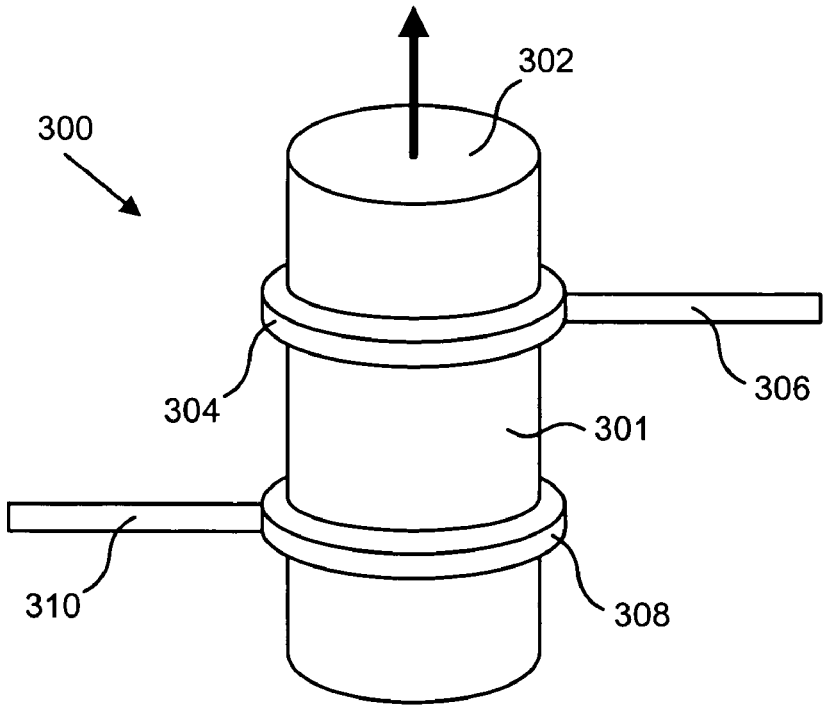
FIG. 3 is a schematic block diagram illustrating one embodiment of an electrode arrangement in accordance with the present invention.

FIG. 3 depicts one embodiment of an electrode arrangement 300 that may be employed in conjunction with certain implementations of a nozzle 301 that is similar to the nozzle 204 in the nozzle array 200 of FIG. 2. The illustrated nozzle 301 is substantially cylindrical in shape, but may be of another shape that is suitable for discharging ink from a pressurized ink chamber 112. At one end, the nozzle 301 defines a discharge outlet 302 that may allow the ink to discharge, in the indicated direction, from the volume defined by the nozzle 301. Although the depicted discharge outlet 302 is circular in plan view, the discharge outlet 302 may have a different shape, including elliptical, rectangular, triangular, and so forth, depending on the printing application in which the present invention may be employed.

The illustrated electrode arrangement 300 includes a first electrode 304 connected to a first electrical lead 306 and a second electrode 308 connected to a second electrical lead 310. In one embodiment, these electrical leads 306,310 may be substantially similar to the electrical leads 206, 208 shown in FIG. 2. As illustrated, the first electrical lead 306 is oriented in a first direction with respect to the nozzle 301 and the second electrical lead 310 is oriented in a second direction with respect to the nozzle 301. In a further embodiment, the electrical leads may be oriented in one of a variety of combinations, including in the same direction, parallel, perpendicular, side-to-side, up-and down, and so forth. Nothing in the present invention limits the orientation of the electrical leads 306, 310 in certain embodiments.

The first and second electrodes 304, 308, in one embodiment, are ring electrodes that each circumscribes a circular section of the nozzle 301. Alternately, if the nozzle 301 is of another shape or orientation, the first and second electrodes 304, 308 may circumscribe portions of the nozzle 301 in a corresponding manner. In a further embodiment, the first and second electrodes 304, 308 may only partially surround a section of the nozzle 301, In this way, either the first electrode 304 or the second electrode 308, or both electrodes 304, 308 may circumscribe only a portion of the nozzle 301 in plan view. For example, in one embodiment, the first and second electrodes 304, 308 may define a "C" shape (not fully circular, possibly semicircular), a "D" shape (partially circular with a straight portion), a "U" shape (partially circular with straight extensions), a square shape, a rectangular shape, a diamond shape, a triangular shape, or any other shape having two or more sides, including approximately straight and circular portions.

In one embodiment, the electrode arrangement 300 allows a voltage difference to be applied between the first electrode 304 and the second electrode 308, thereby creating an electric field between the first and second electrodes 304, 308. The effects of the electric field also may be manifested within the volume defined by the nozzle 301. When an electrorheological fluid is disposed within the volume of the nozzle 301 and an electric field is created between the first and second electrodes 304, 308, the flow of the electrorheological fluid and the orientation of the particles within the electrorheological fluid may be altered.

For example, if an electrorheological ink is flowing through the nozzle 301 and an electric field is created at the nozzle 301, the flow of the electrorheological ink through the nozzle 301 may slow down or even stop, depending on the force of the electric field that is present. In this way, the first and second electrodes 304, 308 are configured to create an electric field that affects the flow of the electrorheological ink so that the electrorheological ink flows more slowly or stops flowing altogether. The combination of the flow-controlling first and second electrodes 304, 308 may be referred to, in on embodiment, as an electrorheological (ER) valve.

Figure 4:
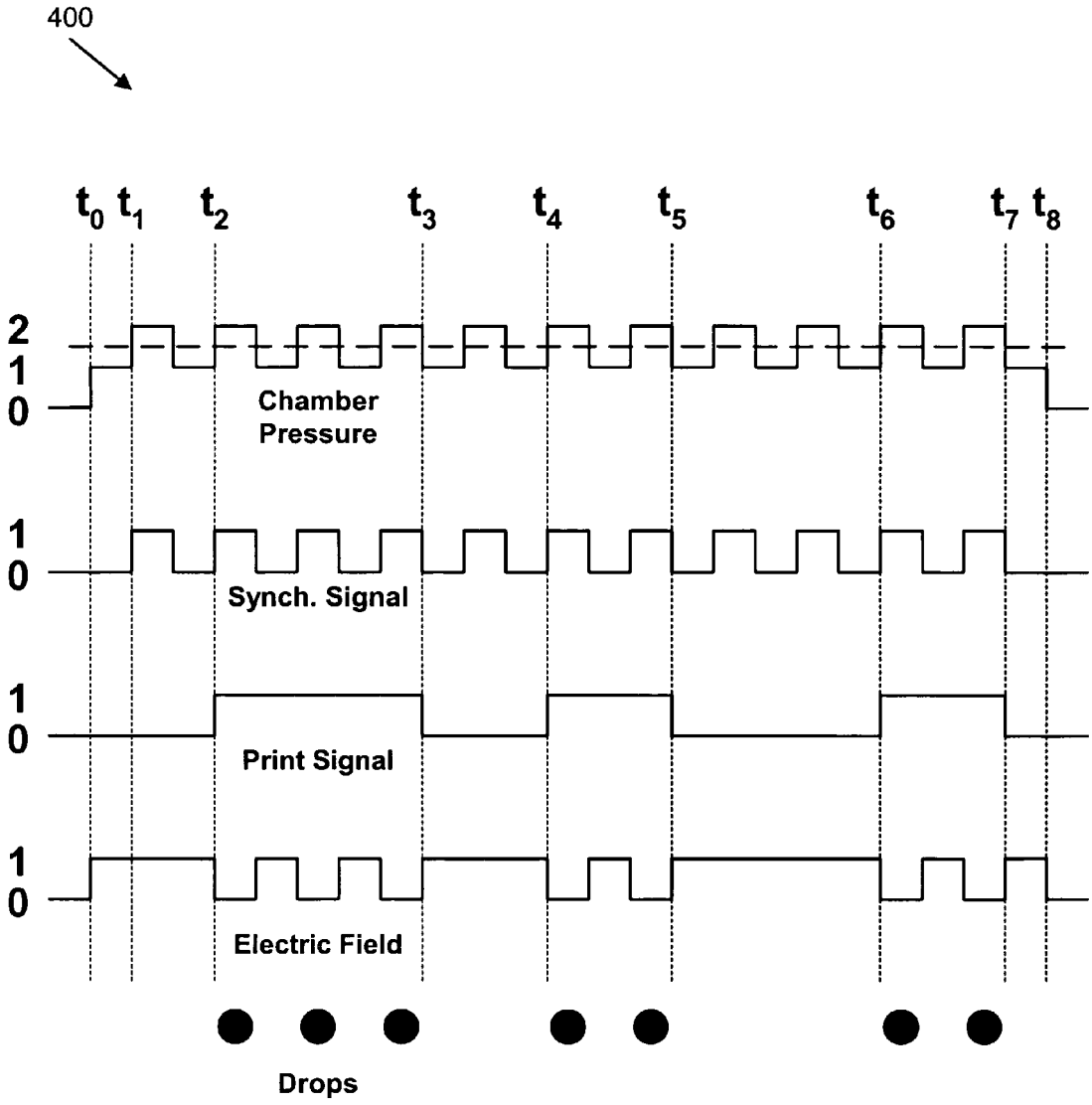
FIG. 4 is a schematic chart illustrating one embodiment of a timing synchronization in accordance with the present invention.

FIG. 4 depicts a timing synchronization chart 400 that is representative of one embodiment of the operation of a drop generator 108 having an ER valve. The illustrated timing synchronization chart 400 shows the state of five aspects present in or related to such a drop generator 108. These aspects are 1) the pressure within the pressurized ink chamber 112, 2) the synchronization signal generated by the stimulator 114, 3) a print signal received from a print source, 4) the electric field generated by the first and second electrodes 304, 308, and 4) the ink drops 120 discharged through the nozzle array 200.

In one embodiment, the state of pressure, synchronization signal, print signal, electric field, and ink drops 120 are all at zero (low, disabled, absent, and so forth) prior to operation of the drop generator 108. At time $t_0$, the pressure in the pressurized ink chamber 112 is raised to a base pressure (level 1). This pressure is below the threshold at which ink may be discharged through the nozzle array 116. The threshold level is indicated by the dashed horizontal line between level 1 and level 2 of the chamber pressure.

Also at time $t_0$, the electric field is energized (level 1). As described above with reference to FIG. 3, energizing the electric field at a nozzle 301 may decrease the flow of an electrorheological ink from the nozzle 301. For ease of explanation, the illustrated timing synchronization chart 400 only includes two states (level 0 and level 1) for the electric field. The first state (level 0) is considered to be fully de-energized and the second state (level 1) is considered sufficiently energized to stop the flow of the electrorheological ink from the nozzle 301. In further embodiments, the electric field may have one or more energy levels between the described first and second states (level 0 and level 1) in which the electrorheological ink may discharge from the nozzle 301 at a decelerated, intermediate rate.

At time $t_1$, the stimulator 114 begins to generate a periodic synchronization signal. Each time the synchronization signal is enabled (level 1), the pressure in the pressurized ink chamber 112 increases above the threshold (level 2). In this way, when the pressure in the pressurized ink chamber 112 is above the threshold (level 2) and the electric field is de-energized (level 0) for a specific nozzle 301, for example, the electrorheological ink drops 120 may discharge through that particular nozzle 301.

On the other hand, when either the pressure is below the threshold (level 0 or level 1) or the electric field is energized (level 1), the electrorheological ink drops 120 do not discharge through the nozzle 301. For example, no ink drops 120 are discharged from the nozzle array 200 between times $t_0$ and $t_2$ because the electric field is energized (level 1). However, at time $t_2$, the electric field becomes de-energized (level 0) approximately during the time when the synchronization signal is enabled (level 1). It is for this reason that three ink drops 120 are discharged in coordination with the synchronization signal until time $t_3$. In one embodiment, the electric field is de-energized (level 0) between times $t_2$ and $t_3$ in response to the print signal that was enabled (level 1). The print signal, in one embodiment, is enabled (level 1) during this time because a print command is received from a print source.

This pattern continues, as shown in the timing synchronization chart 400, generating ink drops 120 between times $t_4$ and $t_5$ and between times $t_6$ and $t_7$. At time $t_7$, the stimulator 114 stops generating a synchronization signal and the pressure in the pressurized ink chamber 112 remains below the threshold to the normal pressurized state (level 1). Subsequently, at time $t_8$, the electric field is de-energized (level 0) and no further ink drops 120 are discharged.

Figure 5:
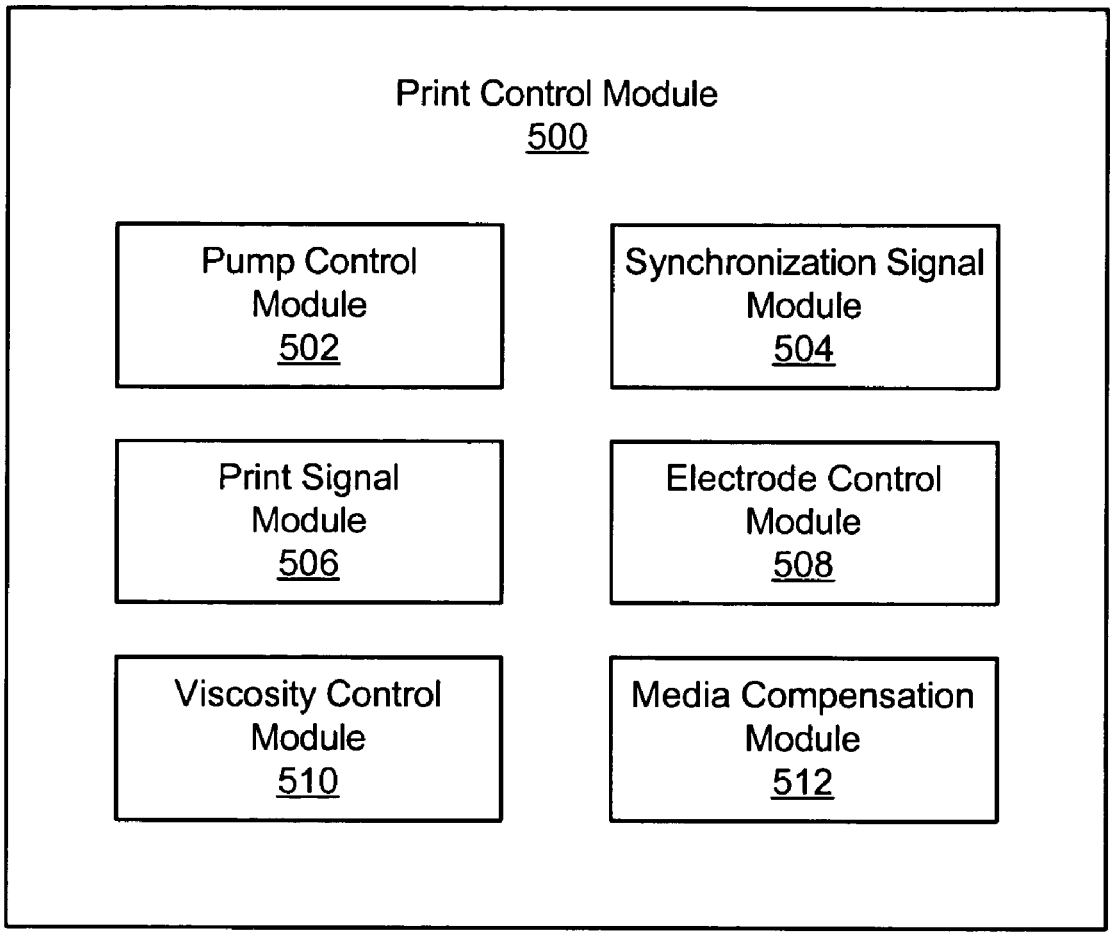
FIG. 5 is a schematic block diagram illustrating one embodiment of a print control module in accordance with the present invention.

FIG. 5 depicts one embodiment of a print control module 500 that may be used in certain embodiments, to control the printing system 100 of FIG. 1. The illustrated print control module 500 includes a pump control module 502, a synchronization control module 504, a print signal module 506, an electrode control module 508, a viscosity control module 510, and a media compensation module 512. Although not shown in FIG. 1, the print control module 500 or modules 502-512 thereof may be connected via control wiring to various components of the printing system 100, including the pump 106, the stimulator 114, the nozzle array 116, and so forth. In a further embodiment, the control operations from the print control module 500 may be processed by a processor (not shown) that is incorporated into the printing system 100.

In one embodiment, the pump control module 502 controls the speed of the pump and, in turn, controls the pressure of the ink in the ink channels 104 and pressurized ink chamber 112. The pump control module 502 may increase the pressure in the pressurized ink chamber 112, in one embodiment, in order to create a desired effect on the ink drops 120 that are discharged from the nozzle array 116.

The synchronization signal module 504, in one embodiment, is configured to control the stimulator 114. In particular, the synchronization signal module 504 may determine how often the synchronization signal is enabled, the period of the synchronization cycle, the amplitude of the enabled synchronization signal, and so forth. As described above, the synchronization signal module 504 may direct the stimulator 114 to either periodically or aperiodically enable the synchronization signal at the drop generator 108.

The print signal module 506 is configured, in certain embodiments, to receive a print signal from a print source, such as a host computer, for example. The print signal module 506, in a further embodiment, also may be configured to directly communicate the received print signal to the printing system 100. Alternately, the print signal module 506 may be configured to generate a new print signal that is coordinated with the synchronization signal so that ink drops 120 may be discharged from the nozzle array 116 in a precise manner.

In one embodiment, the electrode control module 508 controls when voltage is applied to the first electrode 304 and/or the second electrode 308. In one implementation, the first electrode 304 may include a constant reference voltage plane. Alternately, the first electrode 304 may be connected to a ground plane. In another embodiment, a variable voltage may be applied to the first electrode 304.

The electrode control module 508 also may be configured to independently control the voltage for each electrode arrangement 300. In this way, certain nozzles 301 in a nozzle array 200 may be de-energized and discharge ink drops 120 while certain other nozzles in the same nozzle array 200 are energized and do not discharge ink drops 120. In a further embodiment, every electrode arrangement 300 in a nozzle array 200 may be controlled independently so that some nozzles 301 do not discharge, other nozzles 301 discharge at full capacity, and still other nozzles 301 discharge at an intermediate rate due to the presence of an electric field slowing, but not stopping, effect.

The viscosity control module 510 of the print control module 500, in one embodiment, is configured to modify the control of the electrodes 304, 308 so that an electric field of intermediate intensity may be created. In this way, the flow of the electrorheological ink from a nozzle 301 may be slowed, but not completely stopped. The viscosity control module 510, in one embodiment, calculates a modified voltage (or voltages) that may be applied to the first electrode 304 (or both electrodes 304, 308) and communicates the modified voltage(s) to the electrode control module 508. Unless the electrode control module 508 receives a modified voltage for a specific electrode 304, 308, the electrode control module 508 may default to full voltage to create a stopping electric field.

The media compensation module 512, in one embodiment, may be configured to alter the flow of the electrorheological ink from a nozzle 301 in order to accommodate a variation in the feed rate of the printed surface 122 past the drop generator 108 and printing system 100. For example, the media compensation module 512 may monitor, such as by using a sensor (not shown), the actual speed of the printed surface 122 with reference to the drop generator 108. the media compensation module 512 also may calculate a media compensation variable that may be used by the pump control module 502, synchronization signal module 504, print signal module 506, electrode control module 508, or viscosity control module 510 in order to accurately print an ink drop 118 on the print surface 122 while the print surface 122 is moving at a variable speed. The media compensation variable is discussed further with reference to FIG. 7.

The following schematic flow chart diagrams that follow are generally set forth as logical flow chart diagrams. As such, the depicted order and labeled steps are indicative of one embodiment of the presented process. Other steps and processes may be conceived that are equivalent in function, logic, or effect to one or more steps, or portions thereof, of the illustrated process. Additionally, the format and symbology employed are provided to explain the logical steps of the process and are understood not to limit the scope of the process. Although various arrow types and line types may be employed in the flow chart diagrams, they are understood not to limit the scope of the corresponding process. Indeed, some arrows or other connectors may be used to indicate only the logical flow of the process. For instance, an arrow may indicate a waiting or monitoring period of unspecified duration between enumerated steps of the depicted process. Additionally, the order in which a particular process occurs may or may not strictly adhere to the order of the corresponding steps shown.

Figure 6:
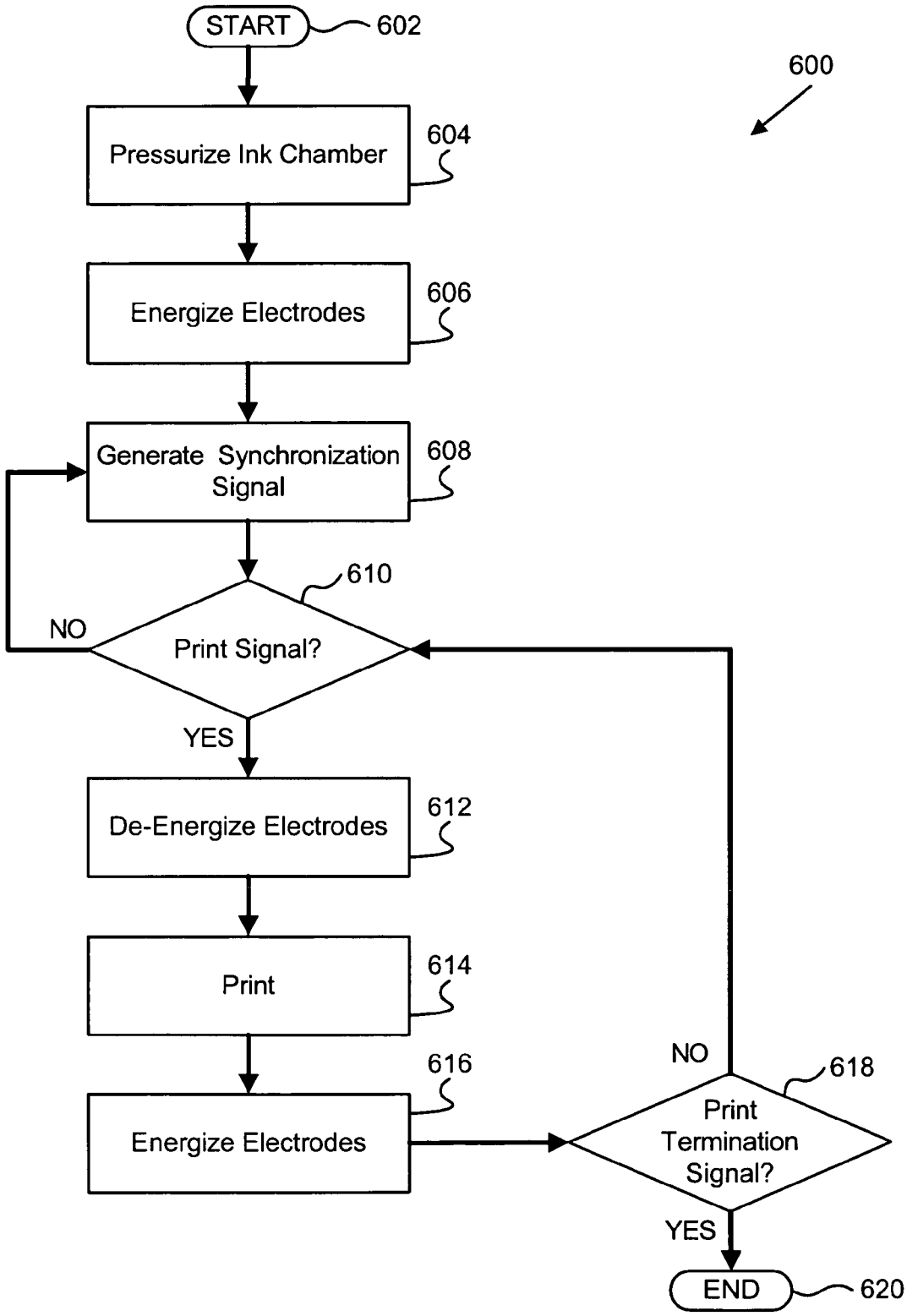
FIG. 6 is a schematic flow chart diagram illustrating one embodiment of a printing method in accordance with the present invention.

FIG. 6 depicts one embodiment of a printing method 600 that may be employed in conjunction with the printing system 100 of FIG. 1. The illustrated printing method 600 begins 602 by pressurizing 604 the ink chamber 112. In one embodiment, the pump control module 502 pressurizes 604 the electrorheological ink in the pressurized ink chamber 112.

The electrode assembly 300 is then energized 606 to create an electric field at the nozzle 301 prior to generating 608 a synchronization signal. In one embodiment, the electrode control module 508 may energize 606 the electrode assembly 300. Similarly, the synchronization signal module 504, in one embodiment, may activate the stimulator 114 to generate 608 the synchronization signal. In a further embodiment, the electrode assembly 300 may be energized 606 after the first pulse of the synchronization signal, allowing an ink drop 118 to discharge from the nozzle 301 on the initial pulse of the synchronization signal. However, there may be little or no advantage over waiting until after the initial pulse of the synchronization signal before energizing 606 the electrode assembly 300.

With the electrorheological ink in the pressurized ink chamber 112, the electrode assembly energized 606, and the stimulator 114 generating 608 a synchronization signal, the printing method 600 determines 610 if a print signal is received at the printing system 100. In one embodiment, the print signal module 506 detects the presence of a print signal sent from a print source to the printing system 100. In a further embodiment, the print module 506 also may modify the received print signal or create a corollary print signal to be used in conjunction with the synchronization signal, as shown in the timing synchronization chart 400 of FIG. 4.

If a print signal is not detected 610, the illustrated printing method 600 continues to generate 608 the synchronization signal. In response to detecting 610 a print signal, the electrode control module 508, in one embodiment, may de-energize 612 the electrode assembly 300 or otherwise cause the electric field to dissipate. In the absence of the electric field, the drop generator 108, for example, prints 614 an ink drop 118 by discharging the electrorheological ink through one or more nozzles 301 in the nozzle array 200. The printing method 600 continues to print 614 each time the synchronization signal is enabled in the absence of the electric field and discontinues printing 614 when the electrode assembly 300 is once again energized 616 or otherwise creates an electric field at the nozzle 301.

After energizing 616 the electrode assembly 300, the printing method 600 determines 618 if a print termination signal is received at the printing system 100 and, if not, returns to monitor 610 for a subsequent print signal. Otherwise, if a print termination signal is detected 618, the depicted printing method 600 then ends 620.

Figure 7:
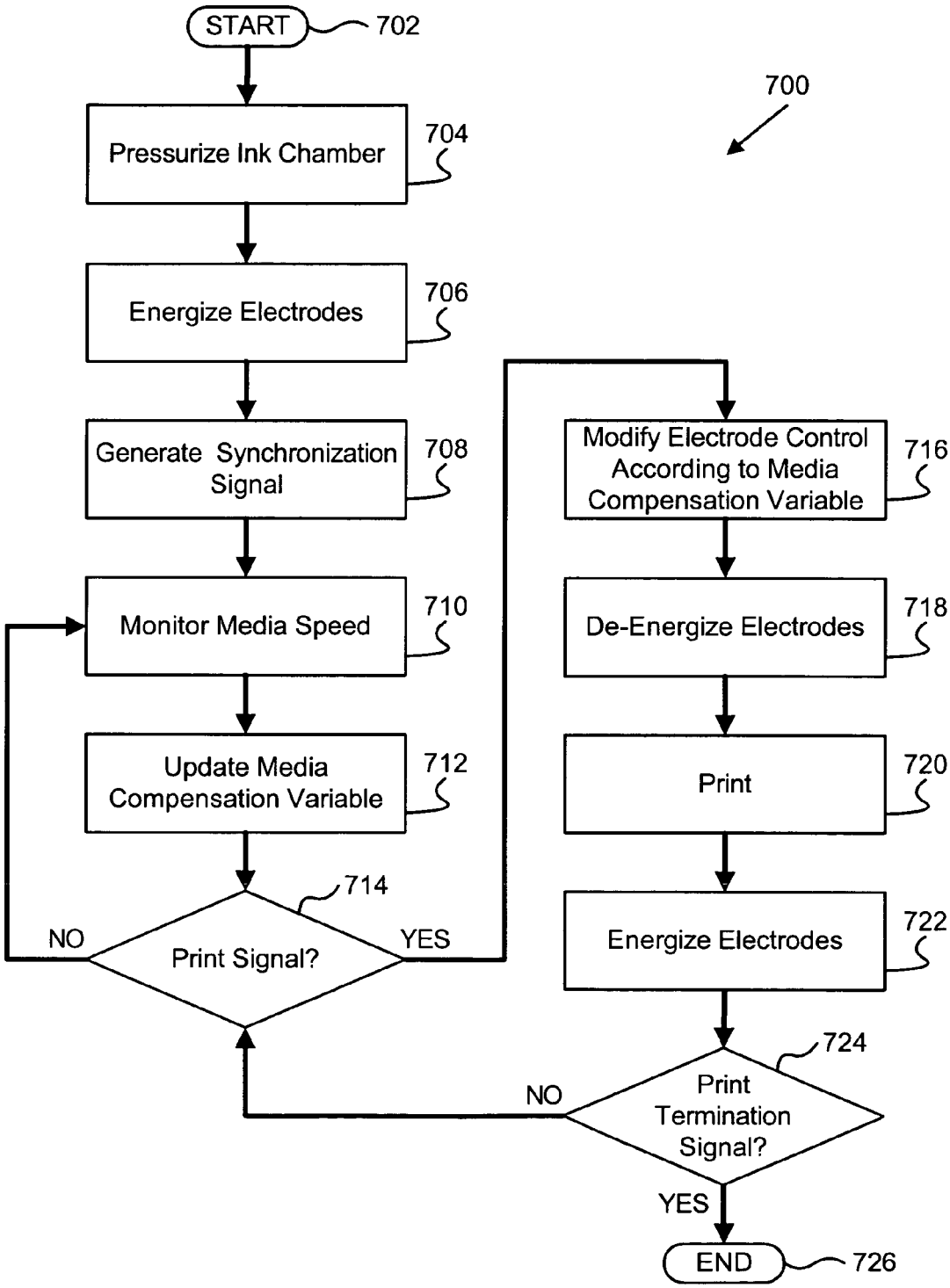
FIG. 7 is a schematic flow chart diagram illustrating one embodiment of a media compensation method in accordance with the present invention.

FIG. 7 depicts one embodiment of a media compensation method 700 that adjusts the printing parameters of the printing system 100 in order to account for a variation in the feed rate of the print surface 122. Many of the features of the media compensation method 700 are substantially similar to the features of the printing method 600 of FIG. 6. Although not shown, a similar viscosity compensation method may be provided to adjust the printing parameters to account for a desired change in the viscosity of the electrorheological ink as it discharges from the nozzle array 200.

The illustrated media compensation method 700 begins 702 by pressurizing 704 the ink chamber 112, energizing 706 the electrode assembly 300, and generating 708 a synchronization signal in a manner similar to the printing method 600. The media compensation method 700 then monitors 710 the media feed rate as the print media 122 passes by the drop generator 108. In one embodiment, the media compensation module 512 samples the speed of the print media 122 at various instances in time.

At certain times after or during monitoring 710 the media feed rate, the media compensation module 508, for example, creates or updates 712 a media compensation variable. In certain embodiments, the media compensation variable is an indicator that relates the sampled 710 media speed to a baseline speed. Alternately, the media compensation variable may be a modifier that is specifically tailored to one or a combination of the pump control module 502, the synchronization signal module 504, the print signal module 506, the electrode control module 508, or the viscosity control module 510. In terms of an analogous viscosity compensation method, a viscosity compensation variable may be substantially similar in application.

When the media compensation method 700 detects 714 a print signal, the media compensation module 512, in one embodiment, communicates the media compensation variable to the electrode control module 508 in order to modify 716 how the electrode assembly 300 is de-energized 718 and then energized 722 once again. In certain embodiments, the electrode control module 508 may send a modified electrode control signal that has a different duration and/or intensity than a non-modified electrode control signal.

The media compensation method 700 continues to monitor 710 the media speed, update the media compensation variable 712, modify 716 the electrode control signal, and print 720 as described above until a print termination signal is received 724. The depicted media compensation method 700 then ends 726.

An advantage of certain embodiments of the present invention is the common process for creating ink drops 118 and discharging the ink drops 118 under the control of the ER valve. As explained above, this advantage is present whether a single nozzle 301 is in use or whether applied to multiple nozzles 301 within a common nozzle array 200.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for electrorheological printing, the apparatus comprising:

a pressurized ink chamber in fluid communication with a nozzle and configured to contain an electrorheological ink, wherein the nozzle includes electrodes for controlling a discharge of the electrorheological ink;

an electrode arrangement configured to create an electric field within the nozzle using a first circular electrode at an inlet to the nozzle and a second circular electrode at an outlet of the nozzle to control a rate of discharge of the electrorheological ink through the nozzle, wherein the electrode arrangement is further configured to create a first magnitude electric field within the nozzle sufficient to stop the discharge of the electrorheological ink through the nozzle and configured to create, within the nozzle, a second magnitude electric field lower than the first magnitude electric field to permit electrorheological ink to discharge through the nozzle;

a stimulator configured to generate a synchronization signal to increase the pressure in the pressurized ink chamber to:

allow the discharge of the electrorheological ink through the nozzle when the electric field created within the nozzle is less than or equal to the second magnitude electric field; and prevent the discharge of the electrorheological ink through the nozzle when the electric field created within the nozzle is greater than or equal to the first magnitude electric field; and a pair of conductive plates aligned in parallel with a path of the electrorheological ink from the outlet of the nozzle to modify the path of the electrorheological ink from the outlet of the nozzle.

2. The apparatus of claim 1, wherein the first ring electrode is connected to a first electrical lead and the second ring electrode is connected to a second electrical lead.

3. The apparatus of claim 2, wherein the first electrical lead is connected to a reference voltage and the second electrical lead is connected to a power supply, the power supply configured to supply a voltage that is different from the reference voltage.

4. The apparatus of claim 1, wherein the nozzle is a first nozzle of a plurality of nozzles forming a nozzle array and the electrode arrangement is one of a plurality of electrode arrangements, each electrode arrangement disposed to control a rate of discharge of a flow of the electrorheological ink through one of the plurality of nozzles.

5. The apparatus of claim 4, wherein a flow of the electrorheological ink through each nozzle of the nozzle array is independently controlled.

6. The apparatus of claim 1, further comprising a print control module configured to control electrorheological printing, the print control module comprising:

a print control module configured to receive a print signal;

a synchronization signal module configured to control the synchronization signal generated by the stimulator; and an electrode control module configured to synchronize a voltage level at the electrode arrangement with the synchronization signal and the print signal.

7. The apparatus of claim 6, wherein the electrode control module is further configured to de-energize the electrode arrangement about when the synchronization signal and the print signal are enabled.

8. The apparatus of claim 6, further comprising a pump control module configured to control a pump to control the pressure in the pressurized ink chamber.

9. The apparatus of claim 6, further comprising a viscosity control module configured to control a viscosity of the electrorheological ink as the electrorheological ink discharges from the nozzle.

10. The apparatus of claim 6, further comprising a media compensation module configured to modify the voltage level at the electrode arrangement to compensate for a variation in a speed of a print media on which the electrorheological ink is being printed.

11. A computer readable storage medium comprising computer readable code configured to carry out a method for electrorheological printing, the method comprising:

pressurizing an electrorheological ink in an ink chamber, wherein the ink chamber is in fluid communication with a nozzle and the nozzle includes electrodes for controlling a discharge of the electrorheological ink;

creating an electric field within the nozzle using a first circular electrode at an inlet to the nozzle and a second circular electrode at an outlet of the nozzle to control a rate of discharge of the electrorheological ink through the nozzle, wherein the electrode arrangement is further configured to create a first magnitude electric field sufficient to stop the discharge of the electrorheological ink through the nozzle and configured to create, within the nozzle, a second magnitude electric field lower than the first magnitude electric field to permit electrorheological ink to discharge through the nozzle;

generating a synchronization signal to increase the pressure in the pressurized ink chamber to:

allow the discharge of the electrorheological ink through the nozzle when the electric field created within the nozzle is less than or equal to the second magnitude electric field; and prevent the discharge of the electrorheological ink through the nozzle when the electric field created within the nozzle is greater than or equal to the first magnitude electric field; and generating an electric charge on a pair of conductive plates aligned in parallel with a path of the electrorheological ink from the outlet of the nozzle to modify the path of the electrorheological ink from the outlet of the nozzle.

12. The computer readable storage medium of claim 11, wherein creating an electric field comprises creating a voltage difference between a first electrode and a second electrode.

13. The computer readable storage medium of claim 11, wherein controlling the rate of discharge of the electrorheological ink through the nozzle comprises changing a viscosity of the electrorheological ink.

14. The computer readable storage medium of claim 11, wherein the method further comprises discharging a drop of the electrorheological ink from the nozzle.

15. The computer readable storage medium of claim 11, wherein the method further comprises de-energizing the electrode arrangement about when the synchronization signal and the print signal are enabled.

16. The computer readable storage medium of claim 11, wherein the method further comprises receiving a print signal.

17. The computer readable storage medium of claim 11, wherein the method further comprises controlling a pump to control the pressure in the pressurized ink chamber.

18. The computer readable storage medium of claim 11, wherein the method further comprises controlling a viscosity of the electrorheological ink as the electrorheological ink discharges from the nozzle.

19. The computer readable storage medium of claim 11, wherein the method further comprises modifying the electric field to compensate for a variation in a speed of a print media on which the electrorheological ink is being printed.

20. A method for electrorheological printing, the method comprising:

pressurizing an electrorheological ink in an ink chamber, wherein the ink chamber is in fluid communication with a nozzle and the nozzle includes electrodes for controlling a discharge of the electrorheological ink;

creating an electric field within the nozzle using a first circular electrode at an inlet to the nozzle and a second circular electrode at an outlet of the nozzle to control a rate of discharge of the electrorheological ink through the nozzle, wherein the electrode arrangement is further configured to create a first magnitude electric field sufficient to stop the discharge of the electrorheological ink through the nozzle and configured to create, within the nozzle, a second magnitude electric field lower than the first magnitude electric field to permit electrorheological ink to discharge through the nozzle;

generating a synchronization signal to increase the pressure in the pressurized ink chamber to:

allow the discharge of the electrorheological ink through the nozzle when the electric field created within the nozzle is less than or equal to the second magnitude electric field; and prevent the discharge of the electrorheological ink through the nozzle when the electric field created within the nozzle is greater than or equal to the first magnitude electric field; and generating an electric charge on a pair of conductive plates aligned in parallel with a path of the electrorheological ink from the outlet of the nozzle to modify the path of the electrorheological ink from the outlet of the nozzle.

* * * * *